US008188018B2

(12) United States Patent
Hashida et al.

(10) Patent No.: US 8,188,018 B2
(45) Date of Patent: May 29, 2012

(54) LUBRICATING OIL COMPOSITION

(75) Inventors: Miyuki Hashida, Ibaraki (JP); Wataru Sawaguchi, Ibaraki (JP); Toshio Nitta, Ibaraki (JP)

(73) Assignee: NOK Kluber Co., Ltd., Tokyo (JP)

( * ) Notice: Subject to any disclaimer, the term of this patent is extended or adjusted under 35 U.S.C. 154(b) by 495 days.

(21) Appl. No.: 12/227,341

(22) PCT Filed: Apr. 18, 2007

(86) PCT No.: PCT/JP2007/058441

§ 371 (c)(1),
(2), (4) Date: Nov. 14, 2008

(87) PCT Pub. No.: WO2007/132626

PCT Pub. Date: Nov. 22, 2007

(65) Prior Publication Data

US 2009/0105103 A1 Apr. 23, 2009

(30) Foreign Application Priority Data

May 16, 2006 (JP) ..... 2006-136336

(51) Int. Cl.
*C10M 169/04* (2006.01)
*C10M 137/10* (2006.01)

(52) U.S. Cl. ..... 508/433; 508/429; 508/214

(58) Field of Classification Search ..... 508/429, 508/422, 214, 433
See application file for complete search history.

(56) References Cited

U.S. PATENT DOCUMENTS

| | | | | |
|---|---|---|---|---|
| 3,935,116 | A * | 1/1976 | Sheratte | 252/78.5 |
| 5,370,809 | A * | 12/1994 | Ishida et al. | 508/304 |
| 2005/0261141 | A1 * | 11/2005 | Iso et al. | 508/154 |

FOREIGN PATENT DOCUMENTS

| | | |
|---|---|---|
| JP | 56-116744 | 9/1981 |
| JP | 61-28592 | 8/1986 |
| JP | 06-306383 | 11/1994 |
| JP | 09-048989 | 2/1997 |
| JP | 09-125086 | 5/1997 |
| JP | 2000-336384 | 12/2000 |
| JP | 2001-172656 | 6/2001 |
| JP | 2001-323293 | 11/2001 |
| JP | 2002-180078 | 6/2002 |

* cited by examiner

*Primary Examiner* — Walter D Griffin
*Assistant Examiner* — Francis C Campanell
(74) *Attorney, Agent, or Firm* — Brinks Hofer Gilson & Lione

(57) ABSTRACT

A lubricating oil composition for use in oil-impregnated sintered bearings together with a resin member having C=C bonds or C=O groups in the molecules, which comprises a base oil comprising a synthetic hydrocarbon oil as the main component, and 0.1-30% by weight of an ester-based oil on the basis of total composition, and free from zinc dialkyldithiophosphate and molybdenum dialkyldithiocarbamate, where the synthetic hydrocarbon oil as the main component of the base oil has substantially no adverse effect on resin, can minimize an adverse effect on various metal species of sintered materials by suppressing a mixing amount of a wear inhibitor or an extreme pressure agent to a minimum, without deteriorating a good lubricability required for the lubricating oil in oil-impregnated sintered bearings.

7 Claims, No Drawings

LUBRICATING OIL COMPOSITION

RELATED APPLICATIONS

The present application is a 35 U.S.C. §371 national stage filing of International Patent Application No. PCT/JP2007/058441, filed Apr. 18, 2007, to which priority is claimed under 35 U.S.C. §120 and through which priority is claimed under 35 U.S.C. §119 to Japanese Priority Patent Application No. 2006-136336, filed May 16, 2006.

TECHNICAL FIELD

The present invention relates to a lubricating oil composition, and more particularly to a lubricating oil composition for use suitably in oil-impregnated sintered bearings together with a resin member.

BACKGROUND ART

Oil-impregnated sintered bearings are a kind of plain bearings, obtained by impregnating a lubricating oil into porous bodies prepared by press molding metallic powders, typically copper powders, iron powders, tin powders, zinc powders, etc. followed by heating and sintering, and used in a self-lubricating mode. The oil-impregnated sintered bearings are cheap, but have a comparatively low friction, a high precision, and are used in a self-lubricating mode, and thus are widely utilized as motor bearings in any desired positions of driving parts for automobile electrical parts, audio-visual appliances, business machines, home electrical appliances, and computer auxiliary memory devices.

Characteristics required for lubricating oil for the oil-impregnated sintered bearings are, for example, good compatibility with bearing materials without any generation of corrosion, sludges, etc.; good applicability in a wide temperature range such as less evaporation loss and good stability against oxidation at high temperatures, less deterioration of fluidity at low temperatures, etc.; good rust prevention; and substantially no adverse effect on resins, a low friction coefficient, a good wear resistance, etc. to meet the recent trends towards down-sizing, lower electric current, and longer durability. Furthermore, the lubricating oil for the oil-impregnated sintered bearings must be able to maintain its performance stability for a long time, because the lubricating oil must be used up without any additional oil supply until the life of service parts comes to an end.

It is particularly important for the lubricating oil for use in oil-impregnated sintered bearings from the viewpoint of the compatibility with bearing materials that the lubricating oil to be impregnated into the porous bodies is forced to contact and coexist with various kinds of metal particles, etc. having a very large surface area, because the oil-impregnated sintered bearings are based on porous bodies prepared by press molding several kinds of metallic powders, and thus can be used stably for a long time without any metal corrosion and sludge generation.

So far proposed lubricating oils or lubricants for oil-impregnated sintered bearings comprise an ester-based oil having a distinguished high-temperature lubricability as the main component of base oil, and a phosphorus-based extreme pressure agent or a sulfur-based extreme pressure agent to suppress frictional abrasion or shaft loss, thereby satisfying such requirements as down-sizing, higher speed, lower electric current, and lower power consumption.

Patent Literature 1: JP No. 3,433,402

Patent Literature 2: JP-A-2001-323293

Patent Literature 3: JP-A-2002-180078

Among the extreme pressure agents, however, there are not a few agents that corrode bearing metals or generate sludges, etc. The resulting corrosion, sludges, etc. will clog up pores of bearings, so the lubricating oil cannot be fully fed to the sliding parts to cause cutting of oil films and lubricating failure, resulting such fatal cases as motor stop within a considerably shorter time than expected. Such inconvenience leads to no more attainment of the characteristics proper to the lubricating oil for oil-impregnated sintered bearings such as self-lubrication and maintenance-free operation.

To ensure practical use in a wide temperature range, the conventional mineral oils, and various synthetic oils such as synthetic hydrocarbon oil, ester-based oil, and fluorocarbon oil have been so far used. Furthermore, to ensure the low evaporation or stability against oxidation at high temperatures, and to maintain the oil film even at high temperatures, a viscosity index improving agent has so far been used. The ester-based oil has a distinguished high-temperature lubricability, but has an adverse effect on resin members, and thus its use is not preferable. That is, use of ester-based oil is preferable from the viewpoint of high-temperature lubricability, but unpreferable from the viewpoint of adverse effect on the resin members. This is an actual problem.

In that case, it may be possible to use base oils of synthetic hydrocarbon oil series having no adverse effect on the resin members, but the viscosity index improving agent or its deteriorated product is less soluble in the synthetic hydrocarbon oil-based lubricating oil, so these insoluble matters will separate out, clog the pores of bearings and disturb the lubricating oil feeding to the sliding parts, often resulting in cutting of oil films and lubricating failure.

DISCLOSURE OF THE INVENTION

Problem To Be Solved By the Invention

Nowadays, resin members are often involved in the oil-impregnated sintered bearings to meet the trend towards lighter weight. Furthermore, resin materials are often used as casing materials to surround the bearings, so lubricants incapable of deteriorating the resin have been desired. More specifically, the ordinary bearings are often encased to prevent the outskirts of bearings from fouling by scattering of leaked lubricant, and in that case deterioration of shaft seals or cases made of resin by contact with the leaked lubricating oil has been encountered as a problem. It has been found that such a problem not occurs when a lubricating oil comprising an ester-based oil as a base oil is applied to resin members made from polyoxyethylene, polyethylene, or polypropylene resin, but the phenomenon is occurred when applied to resin members having C═C bonds or C═O groups in the molecules.

The object of the present invention is to provide a lubricating oil composition containing a synthetic hydrocarbon oil having no adverse effect on resins as main component and for use in oil-impregnated sintered bearings together with resin members having C═C bonds or C═O groups in the molecules, and capable of minimizing adverse effects on various constituent metals of sintered materials, by suppressing a mixing amount of a wear inhibitor or an extreme pressure agent to a minimum without deteriorating the good lubricability required for the lubricating oil for oil-impregnated sintered bearings.

Means For Solving the Problem

The object of the present invention can be attained by a lubricating oil composition for use in oil-impregnated sintered bearings together with a resin member having C═C bonds or C═O groups in the molecules, which comprises a base oil comprising a synthetic hydrocarbon oil as the main component, and 0.1-30% by weight of an ester-based base oil on the basis of the total composition, and free from zinc dialkyldithiophosphate and molybdenum dialkyldithiocarbamate. The meaning of "the oil-impregnated sintered bearings using together with a resin member" means "oil-impregnated sintered bearings positioned close to the resin member" or "oil-impregnated sintered bearings, some of whose metallic constituent members are replaced with a resin constituent member", where the meaning of "the oil-impregnated sintered bearings positioned close to the resin member" means "a mode of the oil-impregnated sintered bearings provided with the resin member in any position within such a range of distance that the lubricating oil leaked out of the oil-impregnated sintered bearings can reach the resin member by bleeding, diffusion or spattering."

Effect of the Invention

The present lubricating oil composition comprises a synthetic hydrocarbon oil having substantially no adverse effect on resins as the main component, and thus can attain substantially no adverse effect on resin members having C═C bonds or C═O groups in the molecules, even if used in the oil-impregnated sintered bearings together with such resin members, whose deterioration is a problem in the case of a base oil consisting only of an ester-based oil. Resin members having C═C bonds or C═O groups in the molecules includes members made from various kinds of resins such as ABS resin (acrylonitrile-butadiene-styrene copolymer resin), polycarbonate resin, acrylic resin, polyamide resin, polyester resin, polyimide resin, polyurethane resin, etc. The present lubricating oil composition can be used in oil-impregnated sintered bearings together with specific resin members, as mentioned above, so the present lubricating oil composition, when brought into contact with shaft seals or casings made from such resin materials, can effectively work as a lubricant without any deterioration of the resin members.

Furthermore, addition of 0.1-30% by weight of an ester-based base oil thereto on the basis of total composition can attain good sliding characteristics without any deterioration of the resin members, so the mixing amount of a wear inhibitor or an extreme pressure agent having a possibility to give adverse effects such as corrosion, etc. on various kinds of constituent metals of sintered materials can be suppressed to a minimum, and even when a less soluble viscosity index improving agent is used in the case of a base oil consisting only of a synthetic hydrocarbon oil, precipitation of the viscosity index improving agent can be suppressed. These are remarkable effects attained by the present lubricating oil composition. Particularly, when a phosphate ester having at least one phenyl ester group, typically tricresyl phosphete, is used as a wear inhibitor or an extreme pressure agent, the present lubricating oil composition can prevent the shaft metal from corrosion. This is another effect of the present invention.

A low-viscosity lubricating oil having a poor oil film retention can be used by blending with the present lubricating oil composition, thereby giving good lubrication thereto. The oil-impregnated sintered bearings impregnated with the present lubrication oil composition can be used stably for a long time without any inconveniences such as corrosion, degradation, sludge generation, and precipitation of viscosity index improving agent.

BEST MODES FOR CARRYING OUT THE INVENTION

The synthetic hydrocarbon oil as the main component for use in the present invention is not particularly limited, and includes, for example, poly-α-olefin, ethylene-α-olefin cooligomer, polybutene, alkyl benzene, alkyl naphthalene, etc. The synthetic hydrocarbon oil is used by blending with 0.1-30% by weight, preferably 1-20% by weight, more preferably 3-10% by weight, of an ester-based base oil on the basis of total composition. When the blending amount of the ester-based base oil is less than 0.1% by weight, the above-mentioned effect of added ester-based base oil cannot be obtained satisfactorily, whereas above 30% by weight, such adverse effects as crack generation of the resin members will be observable. These are unpreferable.

The ester-based base oil for use in the present invention includes monoesters, diesters, polyol esters (complete esters such as neopentyl glycol ester, trimethylolpropane ester, pentaerythritol ester, dipentaerythritol ester, complex ester, etc.), aromatic esters, carbonate esters, etc., and preferably dibasic acid esters. Dibasic acid esters are not particularly limited, and generally it is preferable to use fatty acids of $C_4$-$C_8$, and alcohols of $C_8$-$C_{20}$. In the case of fatty acids having less than 4 carbon atoms and alcohols having less than 8 carbon atoms, sufficiently low volatility will be hard to obtain, whereas in the case of fatty acids having more than 8 carbon atoms and alcohols having more than 20 carbon atoms, the cold resistance will be unsatisfactory.

The dibasic acid esters include, for example, di(2-ethylhexyl)adipate, diisooctyl adipate, diisononyl adipate, diisodecyl adipate, ditridecyl adipate, diisostearyl adipate, di(2-ethylhexyl)azelate, diisooctyl azelate, diisononyl azelate, diisodecyl azelate, ditridecyl azelate, diisostearyl azelate, di(2-ethylhexyl)sebacate, diisooctyl sebacate, diisononyl sebacate, diisodecyl sebacate, ditridecyl sebacate, diisostearyl sebacate, di(2-ethylhexyl)dodecanedicarboxylate, diisooctyl dodecanedicarboxylate, diisononyl dodecanedicarboxylate, diisodecyl dodecanedicarboxylate, ditridecyl dodecanedicarboxylate, diisostearyl dodecanedicarboxylate, etc.

The base oil of the present lubricating oil composition is a synthetic hydrocarbon oil blended with the afore-mentioned specific amount of an ester-based base oil as the essential components, but polyalkylene glycol; synthetic oils such as various phenyl ether oils, various silicone oils, and various fluorinated oils; paraffinic mineral oils; naphthenic mineral oils; or these base oils purified by an appropriate combination of solvent purification, hydrogenation purification, etc. can be used upon blending within such a range as not to spoil the object of the present invention.

Properties of the base oil for various lubricating oils to be used in the present invention are not particularly limited, and can be properly selected according to service conditions. Generally, base oils having a kinematic viscosity (40° C.) of about 2 to about 1,000 $mm^2$/sec, preferably about 5 to about 500 $mm^2$/sec, can be used. When base oils having a kinematic viscosity (40° C.) of less than about 2 $mm^2$/sec, the evaporation loss will be increased, or the oil film strength will be lowered, or so, resulting in a possibility to lower the duration or cause wear or seizure, whereas above a kinetic viscosity (40° C.) of more than about 1,000 $mm^2$/sec., the viscous drag will be increased, or so, resulting in a possibility to develop such inconveniences as an increase in power consumption or torque. The lubricating oil composition can be prepared simply by blending the essential components under stirring.

It is preferable for the lubricating oil composition to add a minimum amount of a wear inhibitor, an extreme pressure agent, and an oiliness agent to the base oil appropriately. Addition of a minimum amount of the wear inhibitor or the extreme pressure agent can prevent corrosion or degradation of shaft materials or generation of sludges, and minimize shaft corrosion to attain good wear resistance characteristics.

The wear inhibitor or the extreme pressure agent for use in the present invention includes, for example, phosphate esters, etc., such as alkyl phosphate esters, aromatic phosphate esters, halogen-containing phosphate esters, acidic phosphate esters, phosphate ester amine salts, etc., and preferably a phosphate ester having at least one phenyl ester group, typically tricresyl phosphate, represented by the following general formula can be used:

$$(R^1R^2C_6H_3O)_nP(O)(OR^3)_{3-n}$$

(where $R^1$ and $R^2$ each are a hydrogen atom, or a linear or branched alkyl group or alkenyl group of $C_1$-$C_{30}$, $R^3$ is the same as $R^1$ and $R^2$, or an aryl group of $C_6$-$C_{30}$, or an aralkyl group of $C_7$-$C_{30}$, and n is 1 or 2). Such an aromatic phosphate ester has a good thermal stability and can prevent corrosion of the frictional surface or generation of sludges.

The mixing amount of the wear inhibitor or the extreme pressure agent can be minimized, when used together with the ester-based base oil, and specifically is 0.1-5% by weight, preferably 0.1-3% by weight, on the basis of total composition. When the mixing amount is more than 5% by weight, there arises a possibility to cause corrosion of frictional surface or generation of sludges, or show an adverse effect on the resin members. Thus, this is not preferable.

The oiliness agent for use in the present invention includes, for example, fatty acid esters of polyhydric alcohols. The fatty acid esters of polyhydric alcohols include partial esters of polyhydric alcohols such as glycerine, sorbitan, alkylene glycol, neopentyl glycol, trimethylolpropane, pentaerythritol, etc. and saturated or unsaturated fatty acids of $C_1$-$C_{24}$. More specifically, glycerine ester includes, for example, glycerine, monlaurate, glycerine monostearate, glycerine monopalmitate, glycerine monooleate, glycerine, dilaurate, glycerine distearate, glycerine dipalmitate, glycerine dioleate, etc.; sorbitane ester includes, for example, sorbitane, monlaurate, sorbitan monopalmitate, sorbitan monostearate, sorbitan monooleate, sorbitan, dilaurate, sorbitan dipalmitate, sorbitan distearate, sorbitan dioleate, sorbitan tristearate, sorbitan, trilaurate, sorbitan trioleate, sorbitan tetraoleate, etc.; alkylene glycol ester includes, for example, ethylene glycol, monlaurate, ethylene glycol monostearate, ethylene glycol monooleate, propylene glycol, monlaurate, propylene glycol monostearate, propylene glycol monooleate, etc.; neopentyl glycol ester includes, for example, neopentyl glycol, monlaurate, neopentyl glycol monostearate, neopentyl glycol monooleate, neopentyl glycol, dilaurate, neopentyl glycol distearate, neopentyl glycol dioleate, etc.; trimethylolpropane ester includes, for example, trimethylolpropane, monlaurate, trimethylolpropane monostearate, trimethylolpropane monooleate, trimethylolpropane, dilaurate, trimethlolpropane distearate, trimethylolpropane dioleate, etc.; and pentaerythritol ester includes, for example, pentaerythritol, monlaurate, pentaerythritol monostearate, pentaerythritol monoleate, pentaerythritol, dilaurate, pentaerythritol distearate, pentaerythritol dioleate, dipentaerythritol monooleate, etc., each of which can be used. Preferably, partial esters of polyhydric alcohols and unsaturated fatty acids can be used. These oiliness agents can be used in a proportion of about 0.01 to about 10% by weight, preferably about 0.05 to about 3% by weight, on the basis of total composition. Above a proportion of about 10% by weight, an adverse effect on the resin member will be observed, and any effect that meets the mixed amount cannot be obtained. This is an economical disadvantage. By using the oiliness agent together with the phosphate ester as a wear inhibitor, both of the friction-reducing effect and the improvement of the wear resistance can be attained.

Other wear inhibitors than the phosphate esters for use in the present invention include, for example, phosphite esters; sulfur-based compounds such as sulfides, disulfides, etc.; and chlorine-based compounds such as chlorinated paraffin, diphenyl chloride, etc. Other oiliness agents than fatty acid esters of polyhydric alcohols for use in the present invention include, for example, fatty acids, higher alcohols, polyhydric alcohols, aliphatic esters, aliphatic amines, and fatty acid monoglycerides, but such organometallic compounds as zinc dialkyldithiophosphate (ZnDTP), molybdenum dialkyldithiocarbamate (MoDTC), etc. have a problem of shaft steel corrosion. Thus, these are not preferable.

The lubricating oil composition can further contain a viscosity index improving agent, which includes, for example, ethylene-propylene copolymer, styrene-isoprene copolymer, polystyrene, polyisobutylene, polyacrylate, polymethacrylate, etc., among which polymethacrylate is preferable. The viscosity index improving agent can be often commercially available as solutions of polymers at a concentration of a several 10% in a solvent, typically a mineral oil. The solvent is preferably a synthetic oil. By adding a solution of the viscosity index improving agent in synthetic oil as a solvent to the lubricating oil composition, the lubricating oil composition can have satisfactory low-evaporation characteristics at high temperature, a stability against oxidation, and a low-temperature flowability, as compared with the case of using a solution of the viscosity index improving agent in the conventional mineral oil as a solvent. The molecular weights of these polymers are not particularly limited, and for satisfactory improvement of viscosity index, the number average molecular weight Mn of the polymers is desirably in a range of about 3,000 to about 1,000,000, preferably about 3,000 to about 300,000. The viscosity index improving agent is used in a proportion of not more than 30% by weight, preferably about 1 to about 10% by weight, on the basis of total composition.

The lubricating oil composition can further contain a thickener, which is not particularly limited, and includes, for example, a soap-based thickener such as Li soap, Ca soap, Al soap, complexed Li soap, complexed Ca soap, complexed Ba soap, etc.; a urea-based thickener such as aliphatic urea, alicyclic urea, aromatic urea, etc.; organic bentonite, PTFE, etc. The thickener can be used in a proportion of about 0.1 to about 40% by weight on the basis of total composition, though dependent on the thickener species.

The lubricating oil composition can further contain well-known additives so far used in the conventional lubricating oil such as a pour point depressant, an ashless dispersant, a metal-based detergent, an antioxidant, a rust preventive, a corrosion inhibitor, a defoaming agent, other wear inhibitors than the phosphate esters, other oiliness agents than the fatty acid esters of polyhydric alcohols, a friction adjuster, etc., if required, which can be used according to service purposes within such a range as not to spoil the object of the present invention. It is desired that these additives must be in a necessary minimum amounts, not to prevent a heat resistance, a low-temperature flowability and a compatibility to shaft material of end products.

The pour point depressant for use herein includes di(tetraparaffin phenol) phthalate, condensation products of tetraparaffin phenol, condensation products of alkylnaphthalene, condensation products of chlorinated paraffin-naphthalene, alkylated polystyrene, etc.; the ashless dispersant includes, for example, succinic acid imide series, succinic acid amide series, benzylamine series, ester series, etc.; the metal-based detergent includes, for example, metal salts each of sulfonic acid, typically dinonylnaphthalene sulfonic acid; alkyl phenol, salicylic acid, etc.

The antioxidant for use herein includes, for example, at least one of phenol series such as 2,6-di-t-butyl-4-methylphenol, 4,4'-methylenebis(2,6-di-t-butylphenol), etc., amine series such as alkyl ($C_4$-$C_{20}$) diphenylamine, triphenylamine, phenyl-α-naphthylamine, alkylated phenyl-α-naphthylamine, phenothiazine, alkylated phenothiazine, etc., phosphorus series, sulfur series, etc. The rust inhibitor includes, for example, fatty acids, fatty acid soaps, alkylsulfonates, fatty acid amines, oxidized paraffin, alkylpolyoxyethylene ether, etc. The corrosion inhibitor includes, for example, benzotriazole, benzoimidazole, thiadiazole, etc. The defoaming agent includes, for example, dimethylpolysiloxane, polyacrylic acid, metal soap, fatty acid esters, phosphate esters, etc.

EXAMPLES

The present invention will be described in detail below, referring to Examples.

Examples 1 to 3, and Comparative Examples 1 to 4

| | Example | | | | Comp. Ex. | | | |
|---|---|---|---|---|---|---|---|---|
| | 1 | 2 | 3 | 4 | 1 | 2 | 3 | 4 |
| Poly-α-olefin (Inobean product Durasyn; kinematic viscosity (40° C.) 15-100 $mm^2$/sec.) | 94.3 | 87.3 | 86.3 | 94.5 | 97.3 | 91.8 | 50.0 | 92.5 |
| Ditridecyl adipate | 3.0 | 10.0 | | 3.0 | | | 47.8 | 3.0 |
| Di(2-ethylhexyl) dodecane-dicarboxylate | | | 5.0 | | | | | |
| Tricrecyl phosphate | 1.0 | 1.0 | 1.0 | 1.0 | 1.0 | | 1.0 | |
| Dilauryl hydrogen phosphite | | | | | | 1.0 | | |
| ZnDTP | | | | | | | | 3.0 |
| Sorbitan monooleate | 0.2 | 0.2 | 0.2 | | 0.2 | 0.2 | 0.2 | |
| Polymethacrylate (Mw: about 200 × $10^3$, poly-α-olefin base) | | | 6.0 | | | 6.0 | | |
| Benzotriazole-based metal inactivator | 0.5 | 0.5 | 0.5 | 0.5 | 0.5 | | | 0.5 |
| Alkylated diphenylamine | 1.0 | 1.0 | 1.0 | 1.0 | 1.0 | 1.0 | 1.0 | 1.0 |

The foregoing components (% by weight) were blended together under stirring to prepare a lubricating oil composition (40° C. kinematic viscosity: about 40 to about 100 $mm^2$/sec.), which was subjected to a shaft corrosion test, resin stress test, wear resistance test, friction coefficient determination, and shaft revolution test.

The results are shown in the following Table.

TABLE

| | Example | | | | Comp. Ex. | | | |
|---|---|---|---|---|---|---|---|---|
| | 1 | 2 | 3 | 4 | 1 | 2 | 3 | 4 |
| Kinematic viscosity | | | | | | | | |
| 40° C. kinematic viscosity | 55.4 | 79.8 | 60.6 | 53.9 | 63.0 | 63.0 | 54.0 | 64.9 |
| −40° C kinematic viscosity | 27,000 | 50,000 | 9,200 | 22,000 | 48,000 | 18,000 | 25,000 | 55,000 |
| viscosity index | 143 | 146 | 205 | 141 | 135 | 200 | 154 | 131 |
| Cu-based shaft corrosion susceptibility | | | | | | | | |
| Shaft color change | none | none | none | none | yes | none | none | yes |
| Shaft corrosion | none | none | none | none | none | yes | none | yes |
| Sludge generation | none | none | none | none | none | yes | none | yes |
| Fe—Cu-based shaft corrosion susceptibility | | | | | | | | |
| Shaft color change | none | none | none | none | yes | none | none | yes |
| Shaft corrosion | none | none | none | none | none | yes | none | yes |
| Sludge generation | none | none | none | none | none | yes | none | yes |
| Resin stress test | | | | | | | | |
| ABS resin | none | none | none | none | none | cracked | cracked | none |
| PC resin | none | none | none | none | none | cracked | cracked | none |
| POM resin | none | none | none | none | none | none | none | none |
| Wear resistance test | 0.53 | 0.54 | 0.58 | 0.57 | 0.63 | 0.41 | 0.56 | 0.46 |
| Friction coefficient determination | 0.106 | 0.120 | 0.118 | 0.131 | 0.121 | 0.109 | 0.123 | 0.151 |
| Shaft revolution test | good | good | good | good | color changed | large sliding flaws | good | color changed |

Determination of the test items were conducted in the following manner:

(Kinematic Viscosity)

Determined at 40° C. and −40° C., according to JIS K2283 corresponding to ASTM D445

(Shaft Corrosion Test)

A Lubrication oil composition sample and test pieces of copper-based shaft or Iron-copper-based shaft were put into a glass tube, and color change and corrosion of the shaft test pieces, and generation of sludges after 120° C. over 500 hours were visually observed (Resin Stress Test)

A stress was applied to resin test pieces, 100 mm×25 mm×2 mm, each of acrylonitrile-butadiene-styrene copolymer [ABS], polycarbonate [PC], and polyoxymethylene [POM; Referential Example] so that the test pieces could be raised by 10 mm higher at the center in the 100 mm longitudinal direction of the resin test pieces, and a lubrication oil composition samples were applied to the center part of the test pieces and appearances of all the resin test pieces were visually observed after 70° C. after 70 hours with respect to color change, cracking or generation of cracks (In the Table, "none" means that there were neither color change nor cracking and generation of cracks through out all the test pieces, and "cracked" means that only generation of cracks was observed in the relevant test pieces)

(Wear Resistance Test)

In a Shell four-ball testing machine, wear flaw diameter (unit: mm) of three lower test steel balls formed by the test under the following conditions was measured Test piece: SUJ2 (½ inch), grade 20

Revolution rate: 1,200 rpm

Load: 40 kgf (3.98 MPa)

Temperature: room temperature

Test duration: 60 minutes (Friction Coefficient Determination)

In a Soda's pendulum-type friction testing machine, a friction coefficient was determined under the following conditions:

Ball: SUJ2 (3/16 inch)

Roller pin: SUJ2

Temperature: room temperature

Load: Left and right edges: 80 g; center: 40 g (Shaft Revolution Test)

A revolution test was conducted in a revolution testing machine provided with a motor, a bearing housing, and a shaft under the following conditions and then surface conditions of sliding material after sliding test were visually observed Revolution rate: 2,000 rpm Load: 3 kgf (0.294 MPa)

Temperature: 85° C.

Test duration: 100 hours

Shaft: Fe—Cu-based oil-impregnated sintered bearing

Shaft material: SUJ2

INDUSTRIAL UTILITY

The present lubrication oil composition can be effectively used as a lubricating oil for oil-impregnated sintered bearings, which are oil-impregnated sintered bearings involving resin members made from resins having C═C bonds or C═O groups in the molecules and susceptible to influences such as crack generation particularly due to added polymethacrylate or excessively added ester oil; and also for oil-impregnated bushes, etc.; furthermore for the ordinary bearings such as ball-and-roller bearings, thrust bearings, kinetic pressure bearings, resin bearings, translation bearings, etc.; power transmission apparatuses such as reduction gears, speed increasers, gears, chain motors, etc.; vacuum pumps; valves; seal pneumatic machines; oil-hydraulic working parts; machine tools such as electrically driven tools, etc.; parts of business machine, such as LBP scanner motors, etc.; PC-HDD-related parts such as fan motors, spindle motors, etc.; parts for use in home electrical precision appliances such as contacts, VTR capstan motors, mobile telephone vibration motors, etc.; various parts for metal processing machines, transfer machines, and railroad, navigation and aviation-related parts; automobile accessories (engine system parts of fuel pumps, etc., air suction-fuel system parts of electronically-controlled throttles, etc., exhaust system parts of exhaust gas recycle units, etc., cooling system parts of water pumps, etc., air conditioning system parts of air conditioners, etc., traveling system parts, brake system parts of ABS, etc., steering system parts, driving system parts of converters, etc., interior and exterior finish system parts of power windows, headlight optical axis-adjusting motors, door mirror motors, etc.), various parts in the food-pharmaceutical industry, the steel, construction and glass industries, the cement industry, the chemical, rubber and resin industries of film tenters, etc., the environment-powder facility, the paper making-printing industries, the timber industry, the fiber-apparel industry, and relative motion-involving machine parts, and parts of internal combustion engine, etc.

The present lubricating oil composition can effectively function as a lubricant, without any deterioration of resin members, when used in motor shaft bearings of home electrical appliances or automobile accessories now in progress of resinification, for example, fan motors and spindle motors for personal computers, OA appliances, general home electrical appliances, etc., small-size motors for note-type personal computers; when used in bearings of fan motors for communication function-provided appliances or car-mounted appliances such as DVD, etc., VTR capstan motors, mobile telephone vibration motors and LBP scanner motors, further when used in bearings in business machine parts, precision machine parts, particularly also when used in oil-impregnated sintered bearings, and also can effectively function, when used in bearings of apparatus for the industry of resin shaft seals, cases, etc.

The invention claimed is:

1. An oil-impregnated sintered bearing that is used together with a resin member having C═C bonds of C═O groups in the molecules wherein the resin member is made of ABS resin, polycarbonate resin, acrylic resin, polyamide resin, polyester resin, polyimide resin, or polyurethane resin and the oil-impregnated sintered bearing is made from a lubricating composition which comprises a base oil comprising a synthetic hydrocarbon oil as the main component, and 0.1-30% by weight of an ester-based base oil on the basis of total composition, and free from zinc dialkyldithiophosphate and molybdenum dialkyldithiocarbamate.

2. An oil-impregnated sintered bearing that is used together with a resin member according to claim 1, wherein the oil-impregnated sintered bearing is positioned sufficiently close to the resin member so that any lubricating oil that leaks out of the oil-impregnated sintered bearing can reach the resin member by bleeding, diffusion or spattering.

3. A lubrication composition according to claim 1, wherein the ester-based base oil is a dibasic acid ester.

4. A lubrication composition according to claim 1, wherein a phosphate ester is further contained as a wear inhibitor.

5. A lubrication composition according to claim 4, wherein the wear inhibitor is a phosphate ester having at least on phenyl ester group represented by the following general formula:

$$(R^1R^2C_6H_3O)_nP(O)(OR^3)_{3-n}$$

(wherein $R^1$ and $R^2$ are each a hydrogen atom, a linear or branched alkyl group or an alkenyl group of $C_1$-$C_{30}$, $R^3$ is the same as $R^1$ and $R^2$, or an aryl group of $C_6$-$C_{30}$ or an aralky group of $C_7$-$C_{30}$, and n is 1 or 2).

6. A lubrication composition according to claim 1, wherein a fatty acid ester of polyhydric alcohol is further contained as an oiliness agent.

7. A lubrication composition according to claim 1, wherein a phosphate ester as a wear inhibitor and a fatty acid ester of polyhydric alcohol as an oiliness agent are further contained.

* * * * *